US008739368B2

(12) United States Patent
Murphy, Jr.

(10) Patent No.: US 8,739,368 B2
(45) Date of Patent: Jun. 3, 2014

(54) EYEGLASS HOLDER

(76) Inventor: H. Stetser Murphy, Jr., Marietta, GA (US)

( * ) Notice: Subject to any disclaimer, the term of this patent is extended or adjusted under 35 U.S.C. 154(b) by 0 days.

(21) Appl. No.: 11/985,648

(22) Filed: Nov. 16, 2007

(65) Prior Publication Data

US 2009/0126159 A1 May 21, 2009

(51) Int. Cl.
*A45F 5/02* (2006.01)

(52) U.S. Cl.
USPC ..... 24/3.3; 24/3.8; 351/155; D3/219; D3/266

(58) Field of Classification Search
CPC .. G02C 3/04; G02C 11/00; A45F 2200/0541; A45F 5/02; A45F 5/00
USPC ..... 24/3.3, 3.7, 3.8, 90.1; 351/155, 112; D11/222; 248/309.1; D3/219, 266
See application file for complete search history.

(56) References Cited

U.S. PATENT DOCUMENTS

| | | | | | |
|---|---|---|---|---|---|
| 471,734 | A | * | 3/1892 | Maier, Jr. | 24/3.3 |
| 543,244 | A | * | 7/1895 | Hills | 24/102 P |
| 617,074 | A | * | 1/1899 | Blumenthal | 24/660 |
| 1,273,204 | A | * | 7/1918 | Tumminello | 24/102 P |
| 1,469,317 | A | * | 10/1923 | Hayward | 24/3.5 |
| 2,235,986 | A | * | 3/1941 | Ellingson | 248/153 |
| 4,043,006 | A | * | 8/1977 | Williams et al. | 24/114.8 |
| 4,157,166 | A | * | 6/1979 | Voelker | 248/317 |
| 4,779,829 | A | | 10/1988 | Rocke et al. | |
| 4,894,887 | A | * | 1/1990 | Ward, II | 24/3.3 |
| 5,033,612 | A | | 7/1991 | Bivins | |
| 5,046,696 | A | | 9/1991 | Lee | |
| 5,319,838 | A | | 6/1994 | Eppenauer | |
| 5,551,126 | A | * | 9/1996 | Wallo | 24/3.3 |
| 5,592,244 | A | | 1/1997 | Vyhmeister | |
| 5,699,140 | A | | 12/1997 | Fuhrman | |
| 5,755,413 | A | * | 5/1998 | Press | 248/175 |
| 5,842,613 | A | | 12/1998 | White | |
| 5,860,191 | A | | 1/1999 | Sieger | |
| 5,893,198 | A | | 4/1999 | DeCotis | |
| 5,933,922 | A | * | 8/1999 | Ochsman | 24/3.11 |
| 5,941,487 | A | | 8/1999 | Keely | |
| 5,956,812 | A | | 9/1999 | Moennig | |
| D416,365 | S | * | 11/1999 | Case et al. | D32/73 |
| 5,975,476 | A | | 11/1999 | Mancinelli | |
| 6,039,173 | A | | 3/2000 | Crow | |
| 6,076,925 | A | * | 6/2000 | Kraut | 351/112 |
| D441,222 | S | * | 5/2001 | Higazy | D6/462 |
| D445,251 | S | | 7/2001 | Newler | |
| 6,389,649 | B1 | * | 5/2002 | Metzler | 24/6 |
| D470,307 | S | * | 2/2003 | McCormack | D3/219 |
| 6,533,414 | B2 | * | 3/2003 | Newler | 351/158 |
| 6,539,587 | B2 | | 4/2003 | Harrison | |
| 6,688,507 | B2 | * | 2/2004 | McCormack | 224/604 |

(Continued)

FOREIGN PATENT DOCUMENTS

| | | |
|---|---|---|
| WO | WO 98/34523 | 8/1998 |
| WO | WO 00/30488 | 6/2000 |

*Primary Examiner* — Robert J Sandy
*Assistant Examiner* — Michael Lee

(57) ABSTRACT

An eyeglass holder for securely retaining a temple piece of an eyeglass therein that prevents accidental loss of the eyeglass during non-use, and further prevents damage thereto is disclosed. The eyeglass holder engages a buttonhole of a shirt for secure retention of the eyeglass, and for secure engagement of the eyeglass holder to prevent loss of the eyeglass holder, such as during extraction of the temple piece.

4 Claims, 2 Drawing Sheets

(56) References Cited

U.S. PATENT DOCUMENTS

| | | | | | |
|---|---|---|---|---|---|
| 6,848,207 | B1 | | 2/2005 | Powell | |
| D512,833 | S | * | 12/2005 | Massaro, Jr. | D3/219 |
| 7,346,934 | B1 | * | 3/2008 | Scott | 2/145 |
| D605,398 | S | * | 12/2009 | Rodriguez | D3/219 |
| D661,091 | S | * | 6/2012 | Murphy, Jr. | D3/266 |
| 2002/0131016 | A1 | | 9/2002 | Newler | |
| 2002/0170147 | A1 | | 11/2002 | Heller | |
| 2003/0014845 | A1 | | 1/2003 | Harrison | |
| 2003/0131449 | A1 | | 7/2003 | McCormack | |
| 2004/0025216 | A1 | * | 2/2004 | Marogil | 2/69 |
| 2005/0146676 | A1 | | 7/2005 | Silvestro | |
| 2005/0241115 | A1 | | 11/2005 | Zoullas | |

* cited by examiner

EYEGLASS HOLDER

TECHNICAL FIELD

The present invention relates generally to special article holders carried by an animate bearer, and more particularly to an eyeglass holder worn by a user.

BACKGROUND OF THE INVENTION

What to do with eyeglasses or sunglasses when removed temporarily poses an enduring frustration for those who depend on them. A pocketbook may be too inconvenient or unavailable, and if placed in a shirt pocket, eyeglasses typically fall out when one bends over; if placed in a pants pocket, eyeglasses may be bent or broken. Thus, there is a need for an alternative way to carry the glasses that is convenient, unobtrusive, and protects against loss or damage.

A familiar way to carry eyeglasses involves attaching respective ends of a cord to each temple piece of the eyeglasses, whereby the eyeglasses may be retained around the wearer's neck to prevent loss thereof during periods of non-use. Unfortunately, the cord leaves room for the eyeglasses to dangle, where they may get in the way, and swing wildly as the wearer moves. Furthermore, such cords are undesirable to some eyeglass wearers who find their appearance unsightly. Finally, because such a cord remains connected to the eyeglasses when worn, it can be annoying or uncomfortable. Other means to carry eyeglasses and protect them from damage and loss after removal include devices attached to the clothing, such as by clips, pins, or the like, which may snag the clothing or inadvertently become detached.

It is clear that there is an unmet need for an unobtrusive body-worn device for retaining eyeglasses when not in use, that provides convenient access to those eyeglasses, and that reduces the risk of the eyeglasses being lost or damaged.

BRIEF SUMMARY OF THE INVENTION

Briefly described, in a preferred embodiment, the present invention overcomes the above-mentioned disadvantages and meets the recognized need for such a device by providing an eyeglass holder that may be securely engaged with clothing, and that reduces the risk of the eyeglasses being lost or damaged.

According to its major aspects, and broadly stated, the eyeglass holder includes a first member for engaging a buttonhole, such as that of a shirt, blouse, coat, or the like, a second member for releasably receiving a temple piece of an eyeglass, and a connector between the first member and the second member to allow the first member to be disposed through the buttonhole to a back side of the buttonhole while allowing the second member to remain disposed on a front side of the buttonhole.

More specifically, the first member preferably comprises a first closed-loop circular ring having a diameter approximately equal to a button of a shirt, whereby the first member may closely pass through a buttonhole of a shirt. The second member preferably comprises a second closed-loop circular ring, spaced from the first member via a connector such that the first member defines a first plane generally parallel to a second plane defined by the second member. As such, the first member preferably remains on an opposite side of the buttonhole from the second member, with the connector positioned through the buttonhole of the shirt.

Subsequently, a button of the shirt may be passed through the buttonhole, effectively retaining the first member and the second member on opposite sides of the buttonhole, whereby the eyeglass holder can not be removed from the shirt without passing the button back through the buttonhole. The second member, disposed on an outside of the shirt, is preferably restrained in a direction of rotation within the second plane, such as by the thread of the button, and also in a direction of motion out of the plane by engagement of the first member with the shirt. Thus, the second member preferably remains securely disposed on the outside of the shirt, generally coplanar therewith, whereby a temple piece of an eyeglass may be removably engaged therewith for retaining the eyeglasses.

Accordingly, one feature and advantage of the present invention is its ability to securely retain eyeglasses, whereby the risk of loss thereof and damage thereto is reduced.

Another feature and advantage of the present invention is its ability to reduce the risk of the holder being dislodged from the garment, such as during removal of the eyeglasses for wearing.

Yet another feature and advantage of the present invention is its ability to limit movement of the eyeglasses retained therein, even when the wearer bends over or moves abruptly.

These and other features and advantages of the present invention will become more apparent to those ordinarily skilled in the art after reading the following Detailed Description of the Invention and Claims in light of the accompanying drawing Figures.

BRIEF DESCRIPTION OF THE DRAWINGS

Accordingly, the present invention will be understood best through consideration of, and with reference to, the following drawing Figures, viewed in conjunction with the Detailed Description of the Invention referring thereto, in which like reference numbers throughout the various Figures designate like structure, and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 1:
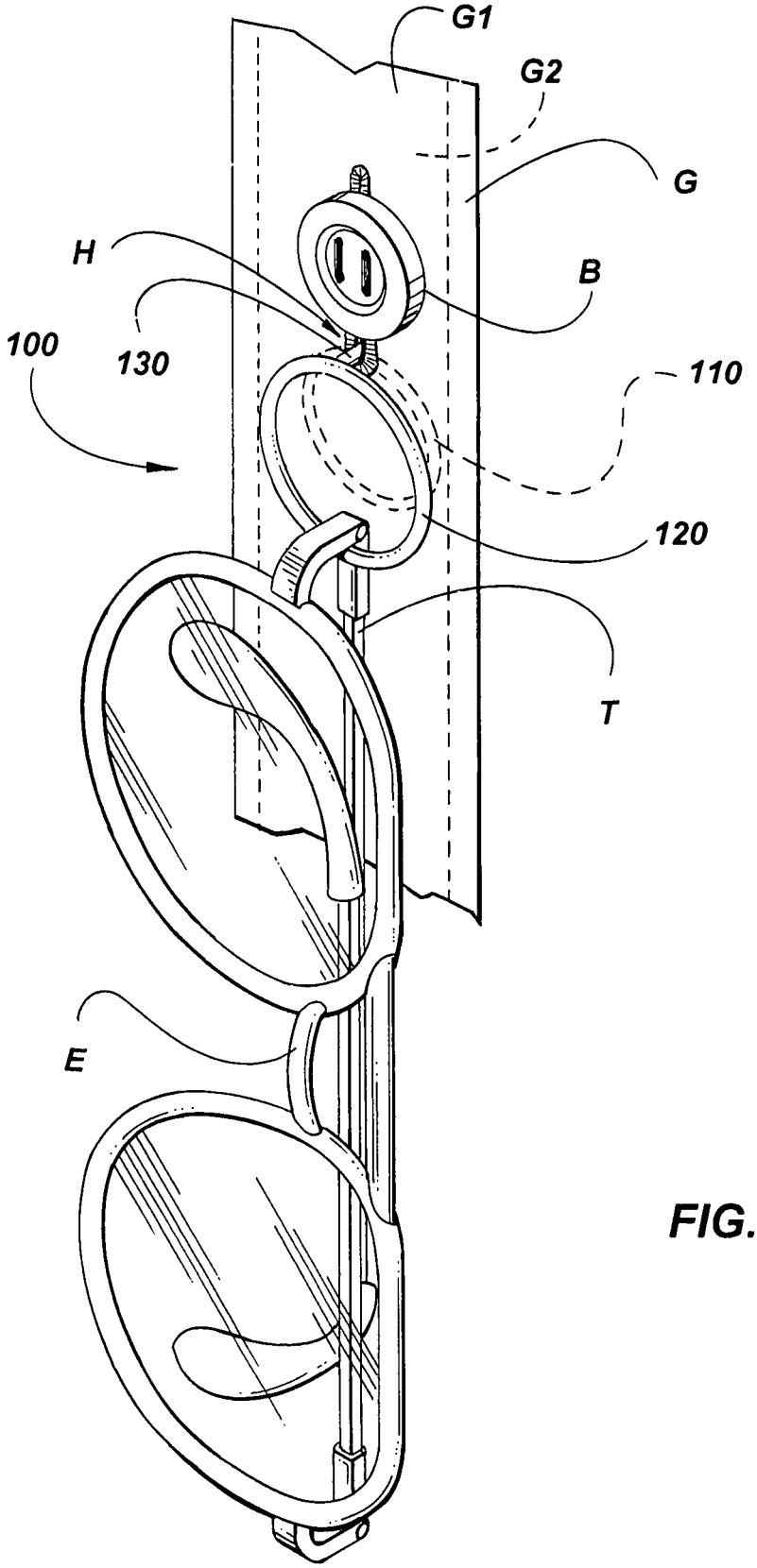
FIG. 1 is a perspective view of an eyeglass holder according to the preferred embodiment of the present invention shown attached to a shirt.
Figure 2:
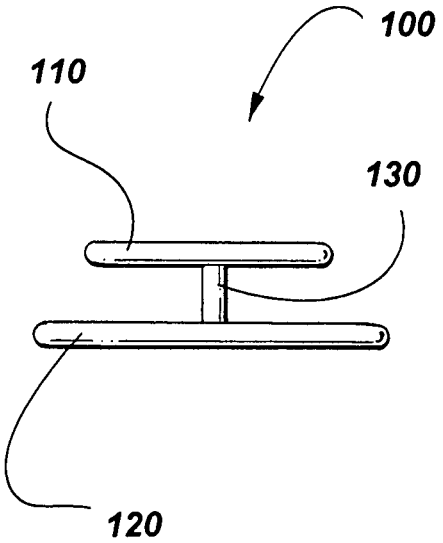
FIG. 2 is a top view of the eyeglass holder of FIG. 1.
Figure 3:
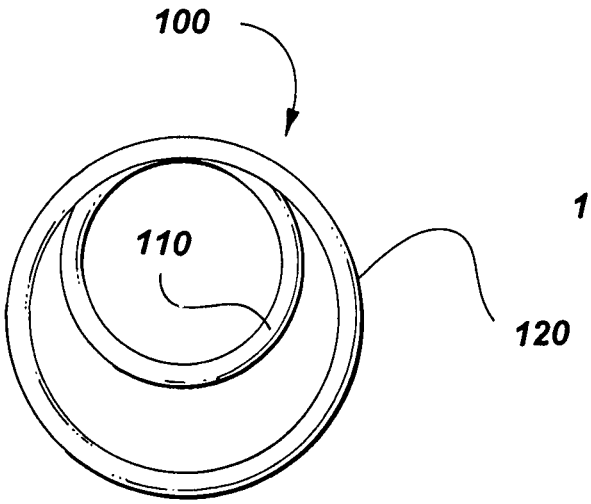
FIG. 3 is a front view of the eyeglass holder of FIG. 1.
Figure 4:
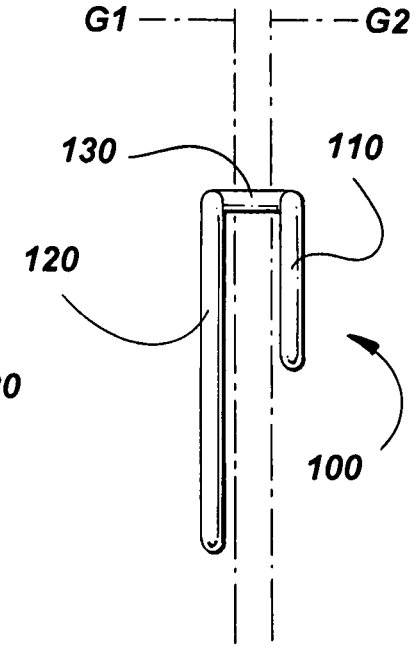
FIG. 4 is a side view of the eyeglass holder of FIG. 1.

In that form of the preferred embodiment of the present invention chosen for purposes of illustration, FIGS. 1-4 show eyeglass holder 100 comprising first generally planar closed-loop member 110, second generally planar closed-loop member 120, and connector 130 therebetween. First member 110 preferably no comprises a closed-loop circular ring, but may, alternatively, be formed as an oval, square, rectangular, triangular, or other shaped ring. Alternatively, first member 110 may be formed as a fixed bar, a pivotal bar, or other open member, so long as first member 110 may pass from first side G1 of garment G to second side G2 through buttonhole H of garment G, such as a shirt. Second member 120 is also preferably formed as a closed-loop circular ring, but may, alternatively, be formed as an oval, square, rectangular, triangular, or other shaped ring. Preferably, second member 120 remains on first side G1, and connector 130 preferably extends from first member 110 to second member 120 through buttonhole H of garment G.

Once first member 110 and connector 130 are disposed through buttonhole H, button B may subsequently be disposed through buttonhole H, thereby preventing first member 110 from passing through buttonhole H. Thus, second member 120 provides an opening through which temple piece T may be inserted to retain eyeglasses E. Passage of button B through buttonhole H preferably restricts rotation of eyeglass holder 100 about a longitudinal axis of connector 130 due to the thread, or other means for attaching button B to garment G, interacting with first member 110. First member 110 preferably further restricts movement of eyeglass holder 100 via interaction with side G2 of garment G, whereby second member 120 is generally retained flat against side G1 of garment G proximate buttonhole H. Accordingly, first member 110 and second member 120 are preferably arranged in generally parallel planes, spaced by connector 130.

Such restriction of motion and the close fit of eyeglass holder 100 within buttonhole H preferably allows eyeglasses E to be securely retained with temple piece T disposed through second member 120 during non-use, whereby eyeglasses E are substantially restricted from swinging or flopping about. Accordingly, it is less likely that eyeglasses E will be damaged when retained within eyeglass holder 100. When needed, eyeglasses E may be disengaged from eyeglass holder 100 via extraction of temple piece T from the opening of second member 120.

Alternatively, first member 110 may be formed such that it is unable to pass through buttonhole H of garment G, such as due to a large dimension thereof. In such case, second member 120 is preferably sized for insertion through buttonhole H from second side G2 to first side G1 of garment G to dispose second member 120 on first side G1 with first member 110 disposed on opposing second side G2, whereby eyeglass holder 100 may be used as described above to retain eyeglasses E via insertion of temple piece T. Button B may likewise be passed through buttonhole H to prevent removal of eyeglass holder 100. Alternatively, eyeglass holder 100 may function as a button stud, such as for use with formal wear.

Each of first member 110, second member 120, and connector 130 may be formed from metal, plastic, rubber, wood, stone, crystal, or other natural or synthetic material, either from a monolithic or integral body, or from separate pieces. Thus, eyeglass holder 100 may comprise a rigid body or a resilient body, as desired, and may incorporate a selected appearance. Similarly, a size, shape, configuration, color, texture, or other characteristic of second member 120, or other component of eyeglass holder 100 may be selected according to the preference of an intended user to create a desired appearance. Likewise, second member 120 may incorporate a graphic or text element to accommodate the user's preference.

Furthermore, one or more of first member 110, second member 120, and connector 130 may be selectively separable from the others, such as via threaded engagement means, or the like. Thus, for example, second member 120 may be removed from connector 130, and a replacement member may be attached to connector 130 in its place, whereby the appearance of eyeglass holder 100 may be altered, such as to accommodate a, user's changing preference, to match a selected outfit, or the like.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is at least:

1. An eyeglass holder operable with a garment comprising:

a planar first closed-loop member;

a planar second closed-loop member;

a connector operably connecting said first closed-loop member to said second closed-loop member, such that said first closed-loop member and said second closed-loop member are parallel to each other;

a garment comprising a first side and a second side and a buttonhole, wherein said connector is disposed through said buttonhole, and wherein said first closed-loop member is disposed on said second side of said garment and said second closed-loop member is disposed on said first side of said garment; and an eyeglass comprising a temple piece, and wherein said temple piece is disposed through said second closed-loop member.

2. The eyeglass holder of claim 1, wherein said first closed-loop member, said second closed-loop member, and said connector are retained so disposed via engagement of a button of the garment with the buttonhole.

3. The eyeglass holder of claim 1, wherein said connector is rigidly attached to said first closed-loop member and said second closed-loop member.

4. The eyeglass holder of claim 1, wherein said first closed-loop member, said second closed-loop member, and said connector comprise metal wire.

* * * * *